United States Patent [19]

Castellanos Manero

[11] 4,437,252

[45] Mar. 20, 1984

[54] RAPID LOADING DEVICE FOR A REVOLVER

[75] Inventor: Carlos E. Castellanos Manero, Miami, Fla.

[73] Assignee: Aida Castellanos Kwasniak, Miami, Fla.

[21] Appl. No.: 225,629

[22] Filed: Jan. 16, 1981

[51] Int. Cl.[3] ..... F42B 39/04

[52] U.S. Cl. ..... 42/89

[58] Field of Search ..... 42/89

[56] References Cited

U.S. PATENT DOCUMENTS

| | | | |
|---|---|---|---|
| 2,637,930 | 5/1953 | Mason | 42/89 |
| 2,896,353 | 7/1959 | Hunt | 42/89 |
| 3,213,559 | 10/1965 | Matich | 42/89 |
| 3,225,482 | 12/1965 | Olson | 42/89 |

*Primary Examiner*—Charles T. Jordan

[57] ABSTRACT

A rapid loading device for a revolver is disclosed which is sized and configurated relative to the cartridge receiving cylinder of a revolver, the device includs a plurality of axially aligned cartridge receiving through holes, conforming generally with the cartridge chambers in the revolver cylinder. The device of the present invention is generally cylindrical in form and of a depth generally conforming with the length of the cartridge shells, and is formed of a highly compressible material such as a conventional closed cell synthetic foam material which is extremely light in weight and is compressible to a thickness which is a very small fraction of its normal cylindrical length. A cartridge is inserted in each through hole with the flanged rims thereof seated against a rear face of the loading device whereby the projectile portions of each cartridge project outwardly of a forward face thereof. In use, the projectile portions are positioned in the gun cylinder chambers and the loading device is completely compressed by the fingers of the loading hand against the rear surface of the gun cylinder. When the fingers are removed, the loading device falls away and the cartridges are fully seated in their respective cylinder chambers.

5 Claims, 4 Drawing Figures

RAPID LOADING DEVICE FOR A REVOLVER

STATE OF THE PRIOR ART

U.S. Pat. No. 881,437 to E. E. Neal discloses a mechanical "Loading Pack" comprised of an annular plate with recesses to receive a plurality of cartridges, and an inner snap ring to hold the cartridges in position for injection into respective cylinder chambers of a revolver. This device remains in place within the cylinder chamber at all times until all of the cartridges contained therein are fired, whereupon, the discharged pack is removed.

U.S. Pat. No. 1,964,171 to J. R. Pflaume, U.S. Pat. No. 2,399,904 to W. W. Baucum and U.S. Pat. No. 4,229,896 to Mike Jurich III all disclose very complex mechanical devices for loading revolvers.

U.S. Pat. No. 3,769,733 to Norman C. Nelson discloses an "Ammunition Loader" for revolvers which is also quite complex and includes a clip, a cartridge clip receiver and a pouch defining a pocket to carry the cartridge clip receiver.

U.S. Pat. No. 4,079,536 to John M. Hunt discloses a "Reloading Apparatus for Revolvers" which is formed of a resiliently deformable material such as rubber and includes a plurality of recesses to respectively engage the flanged butt ends or rims of the cartridges. Main lengths of the shell portions and the entire projectiles of the cartridges project outwardly of the recesses for insertion into the cylinder chambers of a revolver. A frustoconical handle portion of the device comprises a finger grip for insertion of the cartridges into their respective cylinder chambers, whereupon the handle portion is manually manipulated such as a bending or flexing movement thereof to snap the device free of the cartridge rims.

BACKGROUND OF THE PRESENT INVENTION

The present invention is comprised of a very simple, inexpensive and extremely easily operated rapid loading device for a revolver which can be very valuable on occasions when the rapid loading and reloading operations of a resolver are essential, such as in police work, where the lives of the police themselves and members of the general public are often at stake.

Therefore, one of the principal objects of the present invention is to provide a rapid loading and reloading device for a revolver, which carries an array of cartridges of a proper number and caliber size in a manner whereby a single cartridge insertion movement of one hand fully loads the plurality of chambers in the cylinder of a revolver and permits the device to instantly fall away thereafter, whereby the cylinder may be pivoted into position for quick operation of the revolver under emergency conditions.

A further object of the instant invention is to provide a rapid loading device which is cylindrically formed of a suitable conventional synthetic cellular foam material, and which is readily compressible to a very small fraction of its normal length.

Another object of the invention is to provide a rapid loading device which includes no mechanical structure, is very inexpensive to produce and is therefore disposable after a single use, or, if desired, may be reloaded several times, for example, for reuse.

A still further object of the invention is to provide a rapid loading device which is readily adapted for insertion into a small cannister or other small receptacle for personal carriage purposes.

DESCRIPTION OF A PREFERRED EMBODIMENT

Figure 1:
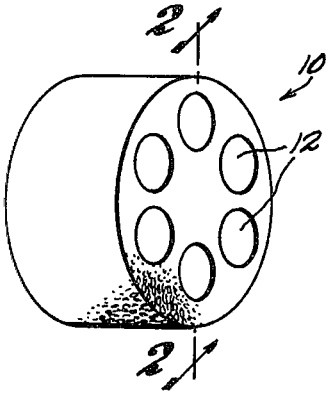
FIG. 1 is a perspective view of the rapid loading device for revolvers of the present invention.

With reference to the drawings and particularly to FIG. 1, the rapid loading device for a revolver, of the present invention, indicated generally at 10, is generally cylindrical in form and of a predetermined length and diameter with a plurality of equally spaced apart holes 12 defined through its length for the reception of a like plurality of cartridges. The illustrated device includes six holes for six cartridges C for use with a revolver incorporating a six chamber cartridge cylinder.

Figure 2:
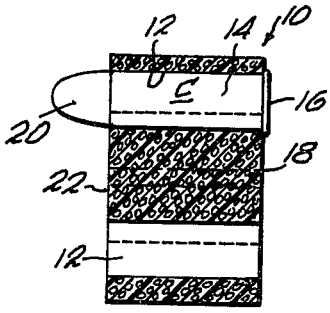
FIG. 2 is a cross sectional view taken along line 2—2 of FIG. 1 with a cartridge disposed in place in one of the through holes therein.

As illustrated in FIG. 2, the holes 12 nest the shells 14 of the cartridges, being of a compatible diameter thereto to releasably maintain the cartridges therein. The length of the cylinder 10, in a preferred form, is substantially equal to the main length of the shell portions 14 of the cartridges with the butt end rim 16 disposed against a rear face 18 of the loading device 10. In the preferred form, the projectile portions 20 of each cartridge C preferably project forwardly outwardly of a front face 22 of the device 10.

Figure 3:
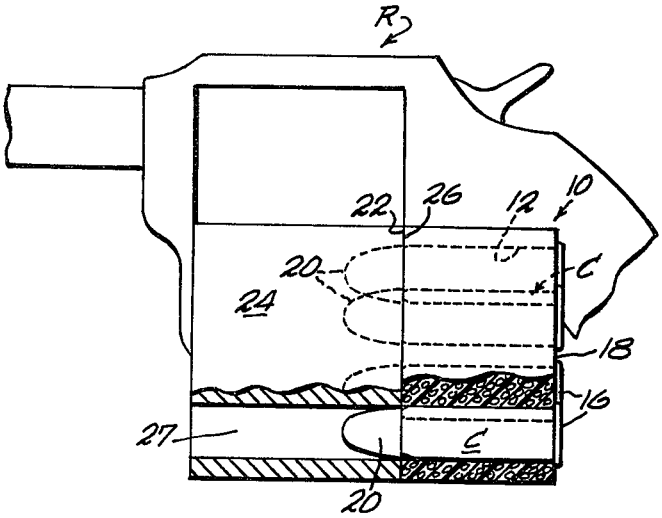
FIG. 3 is a view illustrating the device of FIGS. 1 and 2 with a full complement of cartridges disposed therethrough, and being in a reloading position relative to the chambers in a conventional revolver cylinder.

With reference to FIG. 3, the device 10 is compatibly formed relative to a conventional cartridge cylinder 24 of a revolver R, as to configuration, size and the number of cartridge chambers 12. With further reference to FIG. 3, the loading device 10 is manually positioned against the back face 26 of the gun cylinder 24 in its normal outwardly pivoted position, with the plurality of projectiles 20 of cartridge C positioned into rear end portions of respective cylinder chambers 27.

Figure 4:
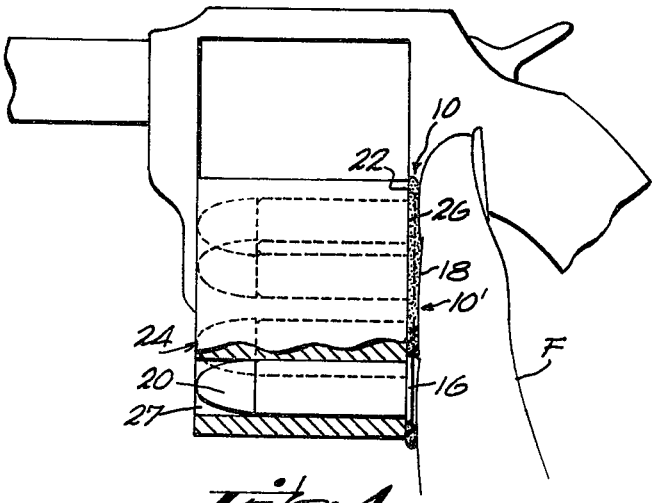
FIG. 4 is a view similar to FIG. 3, illustrating the operation of the device.

To complete the loading operation, fingers F, of one hand, FIG. 4, are pressed against the cartridge rim portions 16 and the rear face 18 of the loading device 10. A minimal amount of finger pressure serves to completely mash or compress the loading devive, because of the nature of the foam material, as indicated at 10' against the rear face 26 of gun cylinder 24. The cartridges, with the exception of rims 16, are completely seated in the chambers 27 and when the finger pressure is released, the loading device 10 simply falls away. To insure its falling away, the finger release is preferably accomplished with an outward or downward wiping movement.

In summary, the loading is accomplished by manually positioning the exposed projectiles 20 in the rear ends of cylinder chambers 27, the exertion of a minimal amount of force against the rear face 18 and cartridge rims 16, and a quick release of the pressure, preferably with a wiping action, and all of the cylinder chambers 27 are loaded and the device 10 simply falls away.

While a preferred form of the present invention has been herein described, it will be obvious to those skilled in the art that various changes and modifications can be made therein without departing from the true spirit of the invention as defined in the appended claims.

I claim:

1. A rapid loading device for a revolver comprising, a generally cylindrical member formed of a conventional synthetic cellular foam material having a very great compressibility quality, said cylindrical member including a plurality of longitudinally extending through holes therein, to coincide with the chambers in a revolver cylinder, for the reception of an ammunition cartridge in each of said chambers.

2. The device as defined in claim 1 wherein each of said through holes is of a predetermined diameter to embrace an outer diameter of one of said cartridges when the cartridge is engaged therein, and said cylindrical member including a rear end face for peripheral engagement about a rear end of each hole by a conventional diametrically enlarged butt end rim of one of the cartridges when so engaged.

3. The device as defined in claim 2 wherein said cylindrical member is of a predetermined lesser length than the overall length of one of the cartridges.

4. The device as defined in claim 3 wherein said predetermined lesser length is substantially equal to a length of the shell of each cartridge, whereby a projectile portion of each cartridge normally extends outwardly of a front face of the cylindrical member.

5. The device as defined in claim 1 wherein said conventional synthetic cellular foam material is of a flexible type which has a memory, and expands generally to its original size and configuration after being manually compressed to a substantially flat condition during a loading operation.

* * * * *